US012618207B2

(12) United States Patent
Wang et al.

(10) Patent No.: US 12,618,207 B2
(45) Date of Patent: May 5, 2026

(54) FABRICATED RAPID CONSTRUCTION PLATFORM FOR BRIDGE AND CONTROL METHOD THEREFOR

(71) Applicant: GUANGXI TRANSPORTATION SCIENCE AND TECHNOLOGY GROUP CO., LTD, Nanning (CN)

(72) Inventors: Hua Wang, Nanning (CN); Longlin Wang, Nanning (CN); Xirui Wang, Nanning (CN); Tianzhi Hao, Nanning (CN); Gangrong Wei, Nanning (CN); Litao Li, Nanning (CN); Bo Qiu, Nanning (CN); Jizhi Luo, Nanning (CN); Yuhou Yang, Nanning (CN); Shijian Liu, Nanning (CN); Mengsheng Yu, Nanning (CN); Xiaoli Zhuo, Nanning (CN); Kainan Huang, Nanning (CN); Jianheng Chen, Nanning (CN); Zengke Li, Nanning (CN); Jipeng Chen, Nanning (CN)

(73) Assignee: GUANGXI TRANSPORTATION SCIENCE AND TECHNOLOGY GROUP CO., LTD, Nanning (CN)

( * ) Notice: Subject to any disclaimer, the term of this patent is extended or adjusted under 35 U.S.C. 154(b) by 504 days.

(21) Appl. No.: 18/038,045

(22) PCT Filed: Oct. 9, 2021

(86) PCT No.: PCT/CN2021/122788

§ 371 (c)(1),
(2) Date: May 22, 2023

(87) PCT Pub. No.: WO2022/151773

PCT Pub. Date: Jul. 21, 2022

(65) Prior Publication Data

US 2024/0003104 A1 Jan. 4, 2024
US 2025/0034821 A2 Jan. 30, 2025

(30) Foreign Application Priority Data

Jan. 14, 2021 (CN) ..... 202110049254.2

(51) Int. Cl.
*E01D 21/00* (2006.01)

(52) U.S. Cl.
CPC ..... *E01D 21/00* (2013.01)

(58) Field of Classification Search
CPC ..... E01D 15/10; E01D 15/12; E01D 15/133; E01D 21/00; E01D 21/06; D01D 15/124; E02B 17/02; E02B 17/021
(Continued)

(56) References Cited

U.S. PATENT DOCUMENTS 5,765,248 A * 6/1998 Ono ..... E04G 1/34 182/178.1
8,387,941 B2 * 3/2013 Qin ..... E01D 21/00 249/1

(Continued)

*Primary Examiner* — William V Gilbert
(74) *Attorney, Agent, or Firm* — Millen, White, Zelano & Branigan P.C.; Ryan R. Pool

(57) ABSTRACT

Provided is a fabricated rapid construction platform for a bridge, including a fixing frame, an upper-layer tubular pile position control structure, a lower-layer tubular pile position control structure, and a console, the fixing frame includes a bottom rail platform, supporting posts, a top operation platform, and several supporting legs; the upper-layer tubular pile position control structure and the lower-layer tubular pile position control structure are provided between the bottom rail platform and the top operation platform; the upper-layer tubular pile position control structure includes two sub-structures arranged symmetrically about the central axis of a second through hole, and each sub-structure includes a braking device, a vertical control arm, and a horizontal control arm. The lower-layer tubular pile position
(Continued)

control structure includes an annular frame, a revolution driving device, and four lower control arms.

20 Claims, 3 Drawing Sheets

(58) Field of Classification Search
USPC ..... 14/77.1, 77.3
See application file for complete search history.

(56) References Cited

U.S. PATENT DOCUMENTS

2019/0330934 A1* 10/2019 Wright ..... E21B 19/09
2022/0025600 A1* 1/2022 Helgesen ..... E02D 27/525

* cited by examiner

FABRICATED RAPID CONSTRUCTION PLATFORM FOR BRIDGE AND CONTROL METHOD THEREFOR

CROSS-REFERENCE TO RELATED APPLICATIONS

This application is a § 371 national phase entry of International Application No. PCT/CN2021/122788, filed Oct. 9, 2021, which claims priority to Chinese Patent Application No. 202110049254.2 filed on Jan. 14, 2021.

TECHNICAL FIELD

The present disclosure relates to the technical field of hoisting construction, and in particular to a fabricated rapid construction platform for a bridge and a control method therefor, thereby being suitable for the installation and connection of tubular piles of a bridge pile-column integrated substructure.

BACKGROUND

As an important infrastructure, bridges are related to the smooth functioning of society and economy. How to build bridges economically, safely and rapidly is an important issue that has long been studied by scholars and engineers. In recent years, with the popularization of fabricated construction technology in the field of bridges, cast-in-place members in bridge structures are gradually replaced by prefabricated members. The construction speed of the bridge has been significantly improved as the members are fabricated uniformly by local factories according to the standard formwork, and then transported by vehicles to the construction site for installation. In this process, the bridge foundation part needs to be manufactured and transported in sections due to its length and weight, and assembled at the construction site. Cranes are required to hoist tubular piles for installation and lowering during assembly, and large cranes are needed as the weight of the prefabricated tubular pile is large and often exceeds 100 t. However, in many cases, the construction site environment is complicated, and the construction site cannot meet the placement of such a large crane, the larger the crane, the greater the cost increases exponentially. Meanwhile, such a way cannot accurately adjust the spatial position of the tubular pile, and thus cannot meet the demands of the fabricated construction.

To solve the problem above, make the installation and connection operation of the tubular piles more standardization and modularization, and reduce the unstable factors in the construction process, a fabricated rapid construction platform for a bridge and a construction method therefor are provided in accordance with the present disclosure.

SUMMARY

In view of the above, it is necessary to provide a fabricated rapid construction platform for a bridge and a control method therefor, so as to solve the problems that the traditional hoisting manners have excessively large local stress, use a large number of apparatuses for hoisting, consumes lone time for hoisting, and have difficulty in controlling accurate connection of joints during a pile connection process.

To achieve the objective above, the technical solution adopted by the present disclosure is as follows:

A fabricated rapid construction platform for a bridge includes a fixing frame, an upper-layer tubular pile position control structure, a lower-layer tubular pile position control structure, and a console.

The fixing frame includes a bottom rail platform, supporting posts, a top operation platform, and multiple supporting legs. The supporting posts are vertically installed at four corners of the top surface of the bottom rail platform, the middle part of the bottom rail platform is provided with a first through hole, and the aperture of the first through hole is greater than the diameter of a prefabricated tubular pile. The top surface of the bottom rail platform is provided with an annular rail, the annular rail surrounds the periphery of the first through hole, and the center of the annular rail is located on the central axis of the first through hole. The top operation platform is installed at the tops of the supporting posts, the middle part of the top operation platform is provided with a second through hole, the central axis of the second through hole coincides with the central axis of the first through hole, and the aperture of the second through hole is greater than the diameter of the prefabricated tubular pile. Multiple supporting legs are arranged on four corners of the bottom rail platform and are installed on the supporting posts or the bottom rail platform, and the bottoms of all supporting legs are located on the same plane. The plane is parallel to the bottom rail platform and is located directly below the bottom rail platform. The upper-layer tubular pile position control structure and the lower-layer tubular pile position control structure are provided between the bottom rail platform and the top operation platform.

The upper-layer tubular pile position control structure is located right above the lower-layer tubular pile position control structure, and includes two sub-structures arranged symmetrically about the central axis of the second through hole, and each sub-structure includes a braking device, a vertical control arm, and a horizontal control arm. The braking device includes a housing, and a vertical jacking cylinder and a horizontal jacking cylinder which are arranged in the housing. A pushing direction of the vertical jacking cylinder is parallel to the central axis of the second through hole, and a pushing direction of the horizontal jacking cylinder is perpendicular to the central axis of the second through hole. The housing is located outside the second through hole, and the side face of the housing facing the central axis of the second through hole is provided with a vertical chute and a horizontal chute. The vertical chute is provided parallel to the central axis of the second through hole, and the vertical control arm is slidingly arranged on the vertical chute; one end of the vertical control arm is connected to the vertical jacking cylinder, and the vertical control arm vertically slides in a length direction of the vertical chute under the action of the vertical jacking cylinder. The horizontal chute is provided parallel to the central axis of the second through hole, and the horizontal control arm is slidingly arranged on the horizontal chute; one end of the horizontal control arm is connected to the horizontal jacking cylinder, and the horizontal control arm horizontally slides in a length direction of the horizontal chute under the action of the horizontal jacking cylinder. The horizontal control arm and the vertical control arm are both telescopic hydraulic rods, telescoping directions of which are parallel to each other and are both perpendicular to the horizontal chute and the vertical chute. The telescopic ends of the horizontal control arm and the vertical control arm are both provided with clamping plates, and the clamping plates are provided facing the central axis of the second through hole.

The lower-layer tubular pile position control structure includes an annular frame, a revolution driving device, and four lower control arms. Rollers are arranged at the bottom of the annular frame, and the annular frame is slidingly connected to the bottom rail platform in a manner that the rollers are slidingly installed on the annular rail. The outer side of the annular frame is provided with an arc-like toothed structure, and the outer frame is meshed with a driving gear of the revolution driving device through the toothed structure. The annular frame is driven by the revolution driving device to rotate around the central axis of the first through hole. The revolution driving device includes the driving gear, a driving shaft and a driving motor. The driving gear is horizontally arranged and is installed on one end of the driving shaft, the other end of the driving shaft is connected to an output shaft of the driving motor, and the driving motor is installed on the fixing frame. The four lower control arms are uniformly distributed on the inner side of the annular frame. Each lower control arm is a telescopic hydraulic rod, a telescopic direction of which is a radial direction of the first through hole, and the telescopic end of the lower control arm is also provided with a clamping plate. The lower control arm, the driving motor, the horizontal control arm, the vertical control arm and the braking device are all connected to a controller of the console.

Further, the bottom rail platform and the top operation platform are both made of rectangular steel plates.

Further, the supporting leg is installed at the lower part of the supporting post.

Further, the supporting leg is a telescopic hydraulic rod.

Further, the annular rail includes an inner annular plate and an outer annular plate which are coaxial. The inner annular plate is located at the inner side of the outer annular plate, the inner annular plate and the outer annular plate are arranged at intervals, and the annular frame is movably arranged on the inner annular plate and the outer annular plate. The inner annular plate is provided with an inner opening for the lower control arm to extend to the inner side of the inner annular plate and for the lower control arm to rotate along with the annular frame. The outer annular plate is provided with an outer opening for the driving gear to mesh with the toothed structure on the annular frame.

Further, the housing is of an inverted T-shaped structure, a vertical edge of the T-shaped housing is provided with the vertical chute and the vertical jacking cylinder, and a transverse edge of the T-shaped housing is provided with the horizontal chute and the horizontal jacking cylinder.

Further, both ends of the transverse edge of the T-shaped housing are respectively fixed to the supporting posts on both sides, and the top of the transverse edge of the T-shaped housing is connected to the top operation platform through a steel pipe truss.

Further, the end face of one end, back to the housing, of the clamping plate is a cambered surface, and the central line of the cambered surface is located on one side of the central axis of the second through hole.

Based on the fabricated rapid construction platform for a bridge above, the present disclosure further provides a control method for the fabricated rapid construction platform for a bridge. The control method includes the following steps:

(1) hoisting, by a crane, a tubular pile, after the bottom of the tubular pile passes through a second through hole of a top operation platform and reaches the position below an upper-layer tubular pile position control structure, starting the upper-layer tubular pile position control structure, enabling vertical control arms and horizontal control arms to clamp the tubular pile, and then removing the crane;

(2) adjusting, by the upper-layer tubular pile position control structure, the horizontal position of the tubular pile, enabling a butt joint structure at the bottom of the tubular pile to face a butt joint structure of a pile body below, then loosening the horizontal control arms, operating the vertical control arms to convey the tubular pile downwards until the bottom of the tubular pile passes through a first through hole of the bottom rail platform;

(3) starting a lower-layer tubular pile position control structure, operating lower control arms to clamp the tubular pile, and then operating the upper-layer tubular pile position control structure to loosen the tubular pile; starting a driving motor of a revolution driving device, rotating the tubular pile until a butt joint part of the butt joint structure at the bottom of the tubular pile faces a butt joint part of a butt joint structure of the pile body below;

(4) manipulating the vertical control arms of the upper-layer tubular pile position control structure to rise to the highest point, and after the tubular pile is clamped by the vertical control arms, enabling the lower control arms of the lower-layer tubular pile position control structure to loosen the tubular pile, and conveying, by the vertical control arms, the tubular pile downwards again; and after the tubular pile reaches the lowest point where the vertical control arm descends or the position where the butt joint structure at the bottom of the tubular pile is in contact with the butt joint structure of the pile body below, clamping the tubular pile again by the lower control arms of the low-layer tubular pile position control structure;

(5) repeating step (4) until the butt joint structure at the bottom of the tubular pile is in contact with the butt joint of the pile body below; and (6) repeating step (1) to step (5) until all tubular piles are installed.

Further, in step (2), the adjustment of the horizontal position of the tubular pile comprises the adjustment of a first horizontal direction perpendicular to a horizontal chute and the adjustment of a second horizontal direction parallel to the horizontal chute. The adjustment of the first horizontal direction is conducted through the expansion and contraction of the vertical control arm and the horizontal control arm, and the adjustment of the second horizontal direction is conducted by driving the horizontal sliding of the horizontal control arm by a horizontal jacking cylinder of a braking device of the upper-layer tubular pile position control structure. The vertical control arms are required to be loosened before the horizontal jacking cylinder operates.

Compared with the prior art, the present disclosure has the following beneficial effects:

1. In accordance with a fabricated rapid construction platform for a bridge provided by the present disclosure, the stress situation of the tubular pile is improved by clamping with multiple control arms, and the safety in the construction process is guaranteed in a manner that the tubular pile is alternately clamped by the upper-layer tubular pile position control structure and the lower-layer tubular pile position control structure for downward conveying.
2. The back-and-forth movement of the tubular pile in the horizontal direction can be achieved through the expansion and contraction action of the vertical control arm and the horizontal control arm of the upper-layer tubular pile position control structure, and the side-to-side movement of the tubular pile in the horizontal direction can be achieved through the horizontal pushing action of the horizontal jacking oil cylinder of the braking device of the upper-layer tubular pile position control structure, that is, the adjustment of the tubular pile in the horizontal direction from front to back and from left to right can be achieved through the upper-layer tubular pile position control structure, thereby achieving the accurate control of the tubular pile position. The providing of a gear structure and the revolution driving device of the lower-layer tubular pile position control structure can achieve the free rotation of the tubular pile during installation to a certain extent, thereby achieving the position adjustment of the butt joint structures during the butt joint of the tubular piles, and facilitating the connection of the two tubular piles.

3. The present disclosure is suitable for the installation engineering of tubular piles with multiple diameters, and the device is convenient to install and move. Meanwhile, the platform is simple in structure, small in volume, convenient to operate, low in cost, and high in promotional value.

BRIEF DESCRIPTION OF THE DRAWINGS

To describe the technical solutions in the embodiments of the present disclosure or in the prior art more clearly, the following briefly introduces the accompanying drawings required for describing the embodiments. Apparently, the accompanying drawings in the following description show merely some embodiments of the present disclosure, and those of ordinary skill in the art may still derive other drawings from these accompanying drawings without creative efforts.

Figure 1:
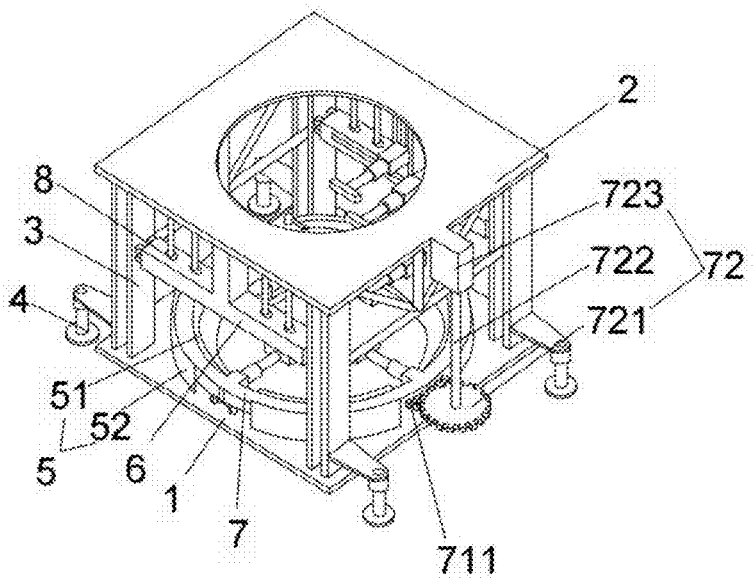
FIG. 1 is a structure diagram of a fabricated rapid construction platform for a bridge in accordance with the present disclosure.

Description of the main component symbols is as follows:

In the drawings: 1—bottom rail platform; 2—top operation platform; 3—supporting post; 4—supporting leg; 5—annular rail; 51—inner annular plate; 52—outer annular plate; 6—upper-layer tubular pile position control structure; 61—braking device; 611—vertical chute; 612—horizontal chute; 62—horizontal control arm; 63—vertical control arm; 7—lower-layer tubular pile position control structure; 71—annular frame; 711—toothed structure; 712—roller; 72—revolution driving device; 721—driving gear; 722—driving shaft; 723—driving motor; 73—lower control arm; 8—steel pipe truss; 9—clamping plate; 10—tubular pile; 101—butt joint structure.

DETAILED DESCRIPTION OF THE EMBODIMENTS

The following clearly and completely describes the technical solutions in the embodiments of the present disclosure with reference to the accompanying drawings in the embodiments of the present disclosure. Apparently, the described embodiments are merely a part rather than all of the embodiments of the present disclosure. All other embodiments obtained by those of ordinary skill in the art based on the embodiments of the present disclosure without creative efforts shall fall within the protection scope of the present disclosure.

To make the objectives, features and advantages of the present disclosure more apparently and understandably, the following further describes the present disclosure in detail with reference to the accompanying drawings and the specific embodiments.

Figure 2:
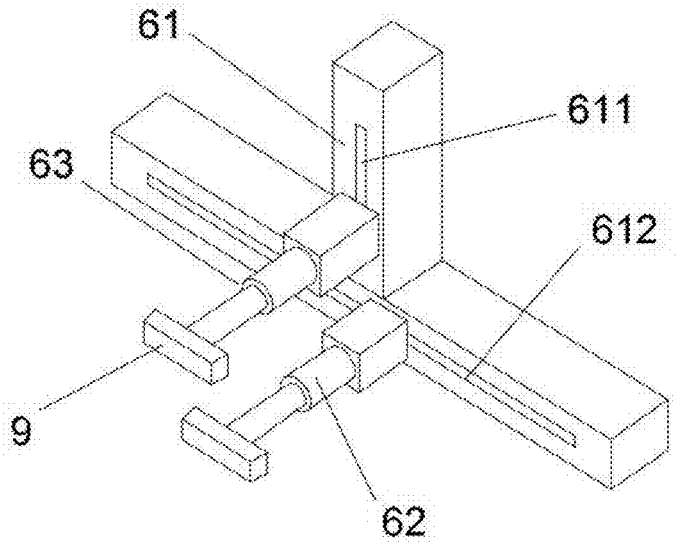
FIG. 2 is a structure diagram of sub-structures of an upper-layer tubular pile position control structure.
Figure 3:
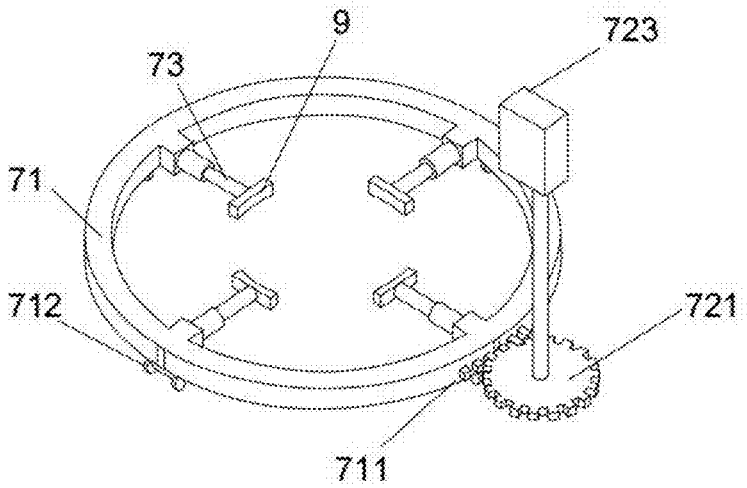
FIG. 3 is a structure diagram of a lower-layer tubular pile position control structure.
Figure 4A:
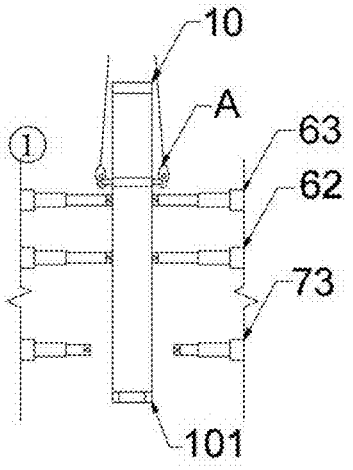
FIGS. 4A-D are an installation flow chart of tubular pile installation in a control method for a fabricated rapid construction platform for a bridge in accordance with the present disclosure, in which A refers to a hoisting point.
Figure 4B:
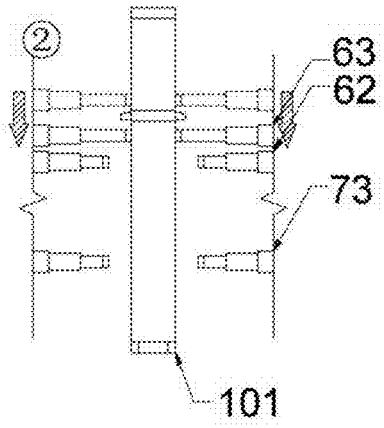
Figure 4C:
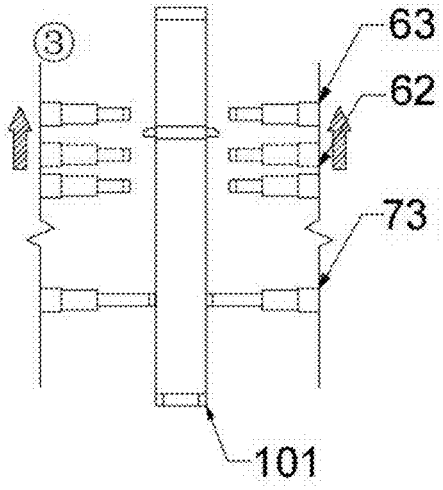
Figure 4D:
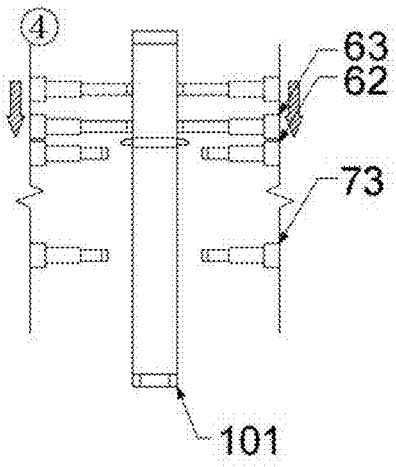

Referring to FIG. 1 to FIGS. 4A-D, in a preferred embodiment of the present disclosure, a fabricated rapid construction platform for a bridge includes a fixing frame, an upper-layer tubular pile position control structure 6, a lower-layer tubular pile position control structure 7, and a console.

The fixing frame includes a bottom rail platform 1, supporting posts 3, a top operation platform 2, and multiple supporting legs 4. The supporting posts 3 are vertically installed at four corners of the top surface of the bottom rail platform 1, the middle part of the bottom rail platform is provided with a first through hole, and the aperture of the first through hole is greater than the diameter of a prefabricated tubular pile. The top surface of the bottom rail platform 1 is provided with an annular rail, the annular rail surrounds the periphery of the first through hole, and the center of the annular rail is located on the central axis of the first through hole. The top operation platform 2 is installed at the tops of the supporting posts 3, and is used to bear the weight of workers and apparatuses for hoisting the tubular pile 10 during hoisting construction. In this embodiment, the top operation platform 2 and the bottom rail platform 1 are both made of rectangular steel plates. The middle part of the top operation platform 2 is provided with a second through hole, the central axis of the second through hole coincides with the central axis of the first through hole, and the aperture of the second through hole is greater than the diameter of the prefabricated tubular pile. Multiple supporting legs 4 are arranged on four corners of the bottom rail platform 1 and are installed on the supporting posts 3 or the bottom rail platform 1, preferably, the lower parts of the supporting posts 3. The supporting legs 4 are telescopic hydraulic rods, so as to lift or lower the fixing frame entirely when needed. The bottoms of all supporting legs 4 are located on the same plane, and the plane is parallel to the bottom rail platform 1 and is located directly below the bottom rail platform. The upper-layer tubular pile position control structure 6 and the lower-layer tubular pile position control structure 7 are provided between the bottom rail platform 1 and the top operation platform 2.

The upper-layer tubular pile position control structure 6 is located right above the lower-layer tubular pile position control structure 7, and includes two sub-structures arranged symmetrically about the central axis of the second through hole, and each sub-structure includes a braking device 61, a vertical control arm 63, and a horizontal control arm 62. The braking device 61 includes a housing, and a vertical jacking cylinder and a horizontal jacking cylinder which are arranged in the housing. In this embodiment, the housing is of an inverted T-shaped structure, a vertical edge of the T-shaped housing is provided with a vertical chute 611 and the vertical jacking cylinder, and a transverse edge of the T-shaped housing is provided with a horizontal chute 612 and the horizontal jacking cylinder. Both ends of the transverse edge of the T-shaped housing are respectively fixed to the supporting posts 3 on both sides of the housing, the top of the transverse edge of the T-shaped housing is connected to the top operation platform 2 through a steel pipe truss 8, so as to improve the stability of the housing on the fixing frame. A pushing direction of the vertical jacking cylinder is provided parallel to the central axis of the second through hole, and a pushing direction of the horizontal jacking cylinder is provided perpendicular to the central axis of the second through hole. The housing is located outside the second through hole, a side face of the housing facing the central axis of the second through hole is provided with a vertical chute 611 and a horizontal chute 612, the vertical chute 611 is provided parallel to the central axis of the second through hole, and the vertical control arm 63 is slidingly arranged on the vertical chute 611. One end of the vertical control arm 63 is connected to the vertical jacking cylinder, and the vertical control arm 63 vertically slides in a length direction of the vertical chute 611 under the action of the vertical jacking cylinder, so as to drive the tubular pile to move in a vertical direction when the tubular pile is clamped by the vertical control arms 63 of the two sub-structures. The horizontal chute 612 is provided parallel to the central axis of the second through hole, and the horizontal control arm 62 is slidingly arranged on the horizontal chute 612. One end of the horizontal control arm 62 is connected to the horizontal jacking cylinder, and the horizontal control arm horizontally slides in a length direction of the horizontal chute 612 under the action of the horizontal jacking cylinder, so as to drive the tubular pipe to move in a horizontal direction when the tubular pile 10 is clamped by the horizontal control arms 62 of the two sub-structures. The horizontal control arm 62 and the vertical control arm 63 are both telescopic hydraulic rods, the telescopic directions of which are parallel to each other and are perpendicular to the horizontal chute 612 and the vertical chute 611, so that the horizontal control arm 62 and the vertical control arm 63 can clamp or loosen the tubular pile in a telescopic manner, and controls the back-and-forth movement of the tubular pile 10 in the horizontal direction when the tubular pile is clamped. The telescopic ends of the horizontal control arm 62 and the vertical control arm 63 are both provided with clamping plates 9, and the clamping plates 9 are provided facing the central axis of the second through hole, so as to clamp the tubular pile better. Further, the end face of one end, back to the housing, of the clamping plate 9 is a cambered surface, the central line of the cambered surface is located on one side of the central axis of the second through hole, so as to prevent the tubular pile from sliding when the tubular pile is clamped. Through the arrangement of the upper-layer tubular pile position control structure 6, the positional adjustment of the tubular pile in the horizontal direction from front to back and from left to right can be achieved, and the tubular pile can be driven to lift or lower in the vertical direction. Specifically, the vertical control arm 63 and the horizontal control arm 62 may be lengthened (shortened) by loading (unloading) the internal hydraulic pressure, so as to clamp (loosen) the tubular pile 10 and adjust the position of the tubular pile. The braking device 61 is responsible for controlling the control arm to move within a certain chute range, so as to position the tubular pile.

The lower-layer tubular pile position control structure 7 includes an annular frame 71, a revolution driving device 72, and four lower control arms 73. The bottom of the annular frame 71 is provided with rollers 712, and the annular frame 71 is slidingly connected to the bottom rail platform 1 in a manner that the rollers 712 are slidingly installed on the annular rail 5. The outer side of the annular frame 71 is provided with an arc-like toothed structure 711, and the annular frame 71 is meshed with a driving gear 721 of the revolution driving device 72 through the toothed structure 711. The annular frame 71 is driven by the revolution driving device 72 to rotate around the central axis of the first through hole. The revolution driving device 72 includes the driving gear 721, a driving shaft 722, and a driving motor 723. The driving gear 721 is horizontally arranged and is installed on one end of the driving shaft 722, and the other end of the driving shaft 722 is connected to an output shaft of the driving motor 723. The driving motor 723 is installed on the fixing frame. The four lower control arms 73 are uniformly distributed on the inner side of the annular frame 71. The lower control arm 73 is a telescopic hydraulic rod, a telescopic direction of which is a radial direction of the first through hole, and the telescopic end of the lower control arm 73 is also provided with a clamping plate 9. The rotation of the tubular pile can be achieved through the above arrangement. Specifically, the tubular pile is clamped by the four lower control arms 73, and the annular frame 71 and the lower control arms 73 thereon are driven to rotate in a manner that the driving motor 723 drives the driving gear 721 to rotate, thereby making the tubular pile rotate. The lower control arm 73, the driving motor 723, the horizontal control arm 62, the vertical control arm 63 and the braking device 61 are all connected to a controller of the console.

Further, in the present disclosure, the annular rail includes an inner annular plate 51 and an outer annular plate 52 which are coaxial. The inner annular plate 51 is located outside the outer annular plate 52, the inner annular plate 51 and the outer annular plate 52 are arranged at intervals, and the annular frame 71 is movably arranged on the inner annular plate 51 and the outer annular plate 52. The inner annular plate 51 is provided with an inner opening for the lower control arm 73 to extend to the inner side of the inner annular plate 51 and for the lower control arm 73 to rotate along with the annular frame 71. The outer annular plate 52 is provided with an outer opening for the driving gear 721 to mesh with the toothed structure 711 of the annular frame 71.

Based on the fabricated rapid construction platform for a bridge, the present disclosure further provides a control method for the fabricated rapid construction platform for a bridge. The control method includes the following steps:

(1) A tubular pile is hoisted by a crane, after the bottom of the tubular pile penetrates through a second through hole of a top operation platform 2 and reaches the position below an upper-layer tubular pile 10 position control structure 6, the upper-layer tubular pile position control structure 6 is started to enable vertical control arms 63 and horizontal control arms 62 to clamp the tubular pipe 10, and then the crane is removed.

(2) The horizontal position of the tubular pile is adjusted through the upper-layer tubular pile position control structure 6 to make a butt joint structure 101 at the bottom of the tubular pile to directly face a butt joint structure 101 of a pile body below, then the horizontal control arms 62 are loosened, the vertical control arms 63 are operated to convey the tubular pile downwards until the bottom of the tubular pile 10 penetrates through a first through hole of the bottom rail platform 1. The adjustment of the horizontal position of the tubular pile includes the adjustment of a first horizontal direction perpendicular to a horizontal chute 612 and the adjustment of a second horizontal direction parallel to the horizontal chute 612. The adjustment of the first horizontal direction is conducted through the extension and contraction of the vertical control arm 63 and the horizontal control arm 62, and the adjustment of the second horizontal direction is conducted by driving the horizontal sliding of the horizontal control arm 62 through the pushing of a horizontal jacking cylinder of a braking device 61 of the upper-layer tubular pile position control structure 6, where the vertical control arm 63 needs to be loosened before the horizontal jacking cylinder operates.

(3) A lower-layer tubular pile position control structure 7 is started, lower control arms 73 are operated to clamp the tubular pile, and then the upper-layer tubular pile position control structure 6 is operated to loosen the tubular pile; a driving motor 723 of a revolution driving device 72 is started to make the tubular pile rotate until the butt joint structure 101 at the bottom of the tubular pile directly faces a butt joint part of the butt joint structure 101 of the pile body below.

(4) The vertical control arms 63 of the upper-layer tubular pile 10 position control structure 6 is manipulated to rise to the highest point, the lower control arms 73 of the lower-layer tubular pile position control structure 7 loosen the tubular pile after the tubular pile is clamped by the vertical control arms 63, and then the tubular pile is conveyed downwards again by the vertical control arms 63; and after reaching the lowest point where the vertical control arms 63 descend or the position where the butt joint structure 101 at the bottom of the tubular pile is in contact with the butt joint structure 101 of the pile body below, the tubular pile is clamped again by the lower control arms 73 of the low-layer tubular pile position control structure 7 again.

(5) Step (4) is repeated until the butt joint structure 101 at the bottom of the tubular pile is in contact with the butt joint structure 101 of the pile body below.

(6) Steps (1) to (5) are repeated until all tubular piles 10 are installed.

It should be noted that for those skilled in the art, apparently, the present disclosure is not limited to details of the exemplary embodiments, and may be expressed in other specific forms without departing from the spirit or basic characteristics of the present disclosure. Therefore, in any way, the embodiments should be regarded as exemplary, not limitative; and the scope of the present disclosure is limited by the appended claims, instead of the above description. Thus, all variations intended to fall into the meaning and scope of equivalent elements of the claims should be covered within the present disclosure. Any reference signs in the claims shall not be regarded as limitations to the concerned claims.

Several examples are used for illustration of the principles and implementation methods of the present disclosure. The description of the embodiments is merely used to help illustrate the method and its core principles of the present disclosure. In addition, those of ordinary skill in the art can make various modifications in terms of specific embodiments and scope of application in accordance with the teachings of the present disclosure. In conclusion, the content of this specification shall not be construed as a limitation to the present disclosure.

What is claimed is:

1. A fabricated rapid construction platform for a bridge, comprising a fixing frame, an upper-layer tubular pile position control structure, a lower-layer tubular pile position control structure, and a console;

wherein the fixing frame comprises a bottom rail platform, supporting posts, a top operation platform, and a plurality of supporting legs;

the supporting posts are vertically installed at four corners of a top surface of the bottom rail platform, and a middle part of the bottom rail platform is provided with a first through hole, and a diameter of the first through hole is greater than a diameter of a prefabricated tubular pile;

the top surface of the bottom rail platform is provided with an annular rail, the annular rail surrounds a periphery of the first through hole, and a center of the annular rail is located on a central axis of the first through hole; the top operation platform is installed at tops of the supporting posts, a middle part of the top operation platform is provided with a second through hole, a central axis of the second through hole coincides with the central axis of the first through hole, and a diameter of the second through hole is greater than the diameter of the prefabricated tubular pile;

the plurality of supporting legs are arranged on four corners of the bottom rail platform and are installed on the supporting posts or the bottom rail platform, and bottoms of the plurality of supporting legs are located on a same plane which is parallel to the bottom rail platform and is located directly below the bottom rail platform;

the upper-layer tubular pile position control structure and the lower-layer tubular pile position control structure are provided between the bottom rail platform and the top operation platform;

the upper-layer tubular pile position control structure is located right above the lower-layer tubular pile position control structure, and comprises two sub-structures arranged symmetrically about the central axis of the second through hole, and each of the two sub-structures comprises a braking device, a vertical control arm, and a horizontal control arm;

the braking device comprises a housing, and a vertical jacking cylinder and a horizontal jacking cylinder which are arranged in the housing;

a pushing direction of the vertical jacking cylinder is parallel to the central axis of the second through hole, and a pushing direction of the horizontal jacking cylinder is perpendicular to the central axis of the second through hole;

the housing is located outside the second through hole, and a side face of the housing facing the central axis of the second through hole is provided with a vertical chute and a horizontal chute; the vertical chute is provided parallel to the central axis of the second through hole, and the vertical control arm is slidingly arranged on the vertical chute;

a first end of the vertical control arm is connected to the vertical jacking cylinder, and the vertical control arm vertically slides in a length direction of the vertical chute under the action of the vertical jacking cylinder;

the horizontal chute is provided parallel to the central axis of the second through hole, and the horizontal control arm is slidingly arranged on the horizontal chute;

a first end of the horizontal control arm is connected to the horizontal jacking cylinder, and the horizontal control arm horizontally slides in a length direction of the horizontal chute under the action of the horizontal jacking cylinder;

the horizontal control arm and the vertical control arm are both telescopic hydraulic rods; a telescoping direction of the horizontal control arm is parallel to a telescoping direction of the vertical control arm; and the telescoping directions of both the horizontal control arm and the vertical control arm are perpendicular to slidable directions of both the horizontal chute and the vertical chute;

telescopic ends of the horizontal control arm and the vertical control arm are both provided with clamping plates, and the clamping plates are provided facing the central axis of the second through hole; and the lower-layer tubular pile position control structure comprises an annular frame, a revolution driving device, and four lower control arms; a plurality of rollers are arranged at a bottom of the annular frame, and the annular frame is slidingly connected to the bottom rail platform in a manner that the rollers are slidingly installed on the annular rail;

an outer side of the annular frame is provided with toothed structure like arc, and the outer frame is meshed with a driving gear of the revolution driving device through the toothed structure;

the annular frame is driven by the revolution driving device to rotate around the central axis of the first through hole;

the revolution driving device comprises the driving gear, a driving shaft and a driving motor; the driving gear is horizontally arranged and is installed on a first end of the driving shaft, and a second end of the driving shaft is connected to an output shaft of the driving motor;

the driving motor is installed on the fixing frame;

the four lower control arms are uniformly distributed on an inner side of the annular frame; each of the lower control arms is a telescopic hydraulic rod, a telescopic direction of which is a radial direction of the first through hole, and a telescopic end of the lower control arm is also provided with a clamping plate; and the lower control arm, the driving motor, the horizontal control arm, the vertical control arm and the braking device are all connected to a controller of the console.

2. The fabricated rapid construction platform for a bridge according to claim 1, wherein the bottom rail platform and the top operation platform are both made of rectangular steel plates.

3. The fabricated rapid construction platform for a bridge according to claim 1, wherein each of the supporting legs is installed at a lower part of a corresponding one of the supporting posts.

4. The fabricated rapid construction platform for a bridge according to claim 1, wherein each of the supporting legs is a telescopic hydraulic rod.

5. The fabricated rapid construction platform for a bridge according to claim 1, wherein the annular rail comprises an inner annular plate and an outer annular plate which are coaxial;

the inner annular plate is located at an inner side of the outer annular plate; and the inner annular plate and the outer annular plate are arranged with an interval therebetween;

the annular frame is movably arranged on the inner annular plate and the outer annular plate;

the inner annular plate is provided with an inner opening for the lower control arm to extend to the inner side of the inner annular plate and for the lower control arm to rotate along with the annular frame; and the outer annular plate is provided with an outer opening for the driving gear to mesh with the toothed structure on the annular frame.

6. The fabricated rapid construction platform for a bridge according to claim 1, wherein the housing is of an inverted T-shaped structure, a vertical edge of the T-shaped housing is provided with the vertical chute and the vertical jacking cylinder, and a transverse edge of the T-shaped housing is provided with the horizontal chute and the horizontal jacking cylinder.

7. The fabricated rapid construction platform for a bridge according to claim 6, wherein both ends of the transverse edge of the T-shaped housing are respectively fixed to the supporting posts that are located on both ends of the transverse edge of the T-shaped housing, and a top of the transverse edge of the T-shaped housing is connected to the top operation platform through a steel pipe truss.

8. The fabricated rapid construction platform for a bridge according to claim 1, wherein an end face of a first end, away from the horizontal control arm or the vertical control arm, of each of the clamping plates is a cambered surface, and the central line of the cambered surface is located on one side of the central axis of the second through hole.

9. A control method for the fabricated rapid construction platform for a bridge according to claim 1, comprising the following steps:

(1) hoisting, by a crane, one of a plurality of tubular piles, after a bottom of the tubular pile passes through a second through hole of a top operation platform and reaches a position below an upper-layer tubular pile position control structure, wherein the position of the tubular pile below the upper-layer tubular pile position control structure enables the vertical control arms and the horizontal control arms to clamp the tubular pile, and then removing the crane;

(2) adjusting, by the upper-layer tubular pile position control structure, the horizontal position of the tubular pile, enabling a first butt joint structure at the bottom of the tubular pile to face a second butt joint structure of a pile body below, then enabling the horizontal control arms to release the tubular pile, operating the vertical control arms to convey the tubular pile downwards until the bottom of the tubular pile passes through a first through hole of the bottom rail platform;

(3) starting a lower-layer tubular pile position control structure, operating the lower control arms to clamp the tubular pile, and then operating the upper-layer tubular pile position control structure to control the lower control arms to release the tubular pile; starting a driving motor of a revolution driving device, rotating the tubular pile until a butt joint part of the butt joint structure at the bottom of the tubular pile faces a butt joint part of a butt joint structure of the pile body below;

(4) manipulating the vertical control arms of the upper-layer tubular pile position control structure to rise to the uppermost point of the vertical chute, and after the tubular pile is clamped by the vertical control arms, operating the lower-layer tubular pile position control structure to control the lower control arms to release the tubular pile, and conveying, by the vertical control arms, the tubular pile downwards again; and after the vertical control arms reaches a lowest point of the vertical chute or the first butt joint structure at the bottom of the tubular pile is in contact with the second butt joint structure of the pile body below, clamping the tubular pile again by the lower control arms of the low-layer tubular pile position control structure;

(5) repeating step (4) until the first butt joint structure at the bottom of the tubular pile is in contact with the second butt joint of the pile body below; and (6) repeating step (1) to step (5) until the plurality of tubular piles are installed to implement longitudinal splicing between the plurality of tubular piles.

10. The control method for the fabricated rapid construction platform for a bridge according to claim 9, wherein in step (2), the adjustment of the horizontal position of the tubular pile comprises the adjustment of a first horizontal direction perpendicular to a horizontal chute and the adjustment of a second horizontal direction parallel to the horizontal chute;

the adjustment of the first horizontal direction is conducted through the expansion and contraction of the vertical control arm and the horizontal control arm; the adjustment of the second horizontal direction is conducted by driving the horizontal sliding of the horizontal control arm by a horizontal jacking cylinder of a braking device of the upper-layer tubular pile position control structure; and the vertical control arms are required to be released before the horizontal jacking cylinder operates.

11. The control method for the fabricated rapid construction platform for a bridge according to claim 9, wherein the bottom rail platform and the top operation platform are both made of rectangular steel plates.

12. The control method for the fabricated rapid construction platform for a bridge according to claim 11, wherein in step (2), the adjustment of the horizontal position of the tubular pile comprises the adjustment of a first horizontal direction perpendicular to a horizontal chute and the adjustment of a second horizontal direction parallel to the horizontal chute; the adjustment of the first horizontal direction is conducted through the expansion and contraction of the vertical control arm and the horizontal control arm; the adjustment of the second horizontal direction is conducted by driving the horizontal sliding of the horizontal control arm by a horizontal jacking cylinder of a braking device of the upper-layer tubular pile position control structure; and the vertical control arms are required to be released before the horizontal jacking cylinder operates.

13. The control method for the fabricated rapid construction platform for a bridge according to claim 9, wherein each of the supporting legs is installed at a lower part of a corresponding one of the supporting posts.

14. The control method for the fabricated rapid construction platform for a bridge according to claim 13, wherein in step (2), the adjustment of the horizontal position of the tubular pile comprises the adjustment of a first horizontal direction perpendicular to a horizontal chute and the adjustment of a second horizontal direction parallel to the horizontal chute; the adjustment of the first horizontal direction is conducted through the expansion and contraction of the vertical control arm and the horizontal control arm; the adjustment of the second horizontal direction is conducted by driving the horizontal sliding of the horizontal control arm by a horizontal jacking cylinder of a braking device of the upper-layer tubular pile position control structure; and the vertical control arms are required to be released before the horizontal jacking cylinder operates.

15. The control method for the fabricated rapid construction platform for a bridge according to claim 9, wherein each of the supporting legs is a telescopic hydraulic rod.

16. The control method for the fabricated rapid construction platform for a bridge according to claim 15, wherein in step (2), the adjustment of the horizontal position of the tubular pile comprises the adjustment of a first horizontal direction perpendicular to a horizontal chute and the adjustment of a second horizontal direction parallel to the horizontal chute; the adjustment of the first horizontal direction is conducted through the expansion and contraction of the vertical control arm and the horizontal control arm; the adjustment of the second horizontal direction is conducted by driving the horizontal sliding of the horizontal control arm by a horizontal jacking cylinder of a braking device of the upper-layer tubular pile position control structure; and the vertical control arms are required to be released before the horizontal jacking cylinder operates.

17. The control method for the fabricated rapid construction platform for a bridge according to claim 9, wherein the annular rail comprises an inner annular plate and an outer annular plate which are coaxial;

the inner annular plate is located at an inner side of the outer annular plates and the inner annular plate and the outer annular plate are arranged with an intervals therebetween; the annular frame is movably arranged on the inner annular plate and the outer annular plate;

the inner annular plate is provided with an inner opening for the lower control arms to extend to the inner side of the inner annular plate and for the lower control arms to rotate along with the annular frame; and the outer annular plate is provided with an outer opening for the driving gear to mesh with the toothed structure on the annular frame.

18. The control method for the fabricated rapid construction platform for a bridge according to claim 17, wherein both ends of the transverse edge of the T-shaped housing are respectively fixed to the supporting posts that are located on both ends of the transverse edge of the T-shaped housing, and a top of the transverse edge of the T-shaped housing is connected to the top operation platform through a steel pipe truss.

19. The control method for the fabricated rapid construction platform for a bridge according to claim 9, wherein the housing is of an inverted T-shaped structure, a vertical edge of the T-shaped housing is provided with the vertical chute and the vertical jacking cylinder, and a transverse edge of the T-shaped housing is provided with the horizontal chute and the horizontal jacking cylinder.

20. The control method for the fabricated rapid construction platform for a bridge according to claim 9, wherein an end face of a first end, away from the horizontal control arm or the vertical control arm, of each of the clamping plates is a cambered surface, and the central line of the cambered surface is located on one side of the central axis of the second through hole.

* * * * *